US007673674B2

(12) United States Patent
Lam

(10) Patent No.: US 7,673,674 B2
(45) Date of Patent: Mar. 9, 2010

(54) POLISH ROD CLAMPING DEVICE

(75) Inventor: Tony M. Lam, Edmonton (CA)

(73) Assignee: Stream-Flo Industries Ltd., Edmonton (CA)

( * ) Notice: Subject to any disclaimer, the term of this patent is extended or adjusted under 35 U.S.C. 154(b) by 446 days.

(21) Appl. No.: 11/669,849

(22) Filed: Jan. 31, 2007

(65) Prior Publication Data

US 2007/0175625 A1 Aug. 2, 2007

Related U.S. Application Data

(60) Provisional application No. 60/763,618, filed on Jan. 31, 2006.

(51) Int. Cl.
*E21B 19/00* (2006.01)

(52) U.S. Cl. ..... 166/75.11; 166/75.14; 294/119.1

(58) Field of Classification Search ..... 166/75.14, 166/75.11, 68.5; 251/1.3; 294/119.1, 86.1
See application file for complete search history.

(56) References Cited

U.S. PATENT DOCUMENTS 984,287 A * 2/1911 Morimura ..... 175/171
1,048,705 A 12/1912 Kleffman
1,629,584 A 5/1927 O'Boyle et al.
1,851,894 A 3/1932 Clough
1,855,347 A 4/1932 Goble
2,194,260 A 3/1940 Allen
2,385,463 A 9/1945 Penick
2,969,838 A 1/1961 Wilde
3,817,326 A 6/1974 Meynier, III
4,303,270 A * 12/1981 Adair ..... 294/88
4,363,475 A 12/1982 McCarty
4,476,935 A 10/1984 Hynes et al.
4,690,213 A * 9/1987 Stannard et al. ..... 166/84.4
4,844,406 A 7/1989 Wilson
5,149,071 A 9/1992 Oliveira
5,400,857 A 3/1995 Whitby et al.

(Continued)

FOREIGN PATENT DOCUMENTS

CA 1050419 3/1979

(Continued)

OTHER PUBLICATIONS

Bowen Tools, Inc. Excerpts from 1978-1979 catalog.

(Continued)

*Primary Examiner*—Kenneth Thompson
(74) *Attorney, Agent, or Firm*—Greenlee Winner and Sullivan PC

(57) ABSTRACT

A polish rod clamping device, for use as part of a wellhead production pumping tree to secure a polish rod. The device includes a pressure-containing body forming a central vertical and opposed first and second side bores. A pair of clamping rams are positioned in the side bores for sliding movement therealong, each clamping ram having a front and a rear end, the front ends of the clamping rams being configured to accommodate at least a portion of the polish rod between their front ends when the clamping rams are advanced across the central bore. The front end of at least one of the clamping rams is configured with a vertical V-groove for gripping the polish rod. The invention extends to the V-groove rams themselves and to composite wellhead assemblies containing the V-groove clamping device.

34 Claims, 8 Drawing Sheets

U.S. PATENT DOCUMENTS

| | | | | |
|---|---|---|---|---|
| 5,575,451 | A * | 11/1996 | Colvin et al. | 251/1.3 |
| 5,577,556 | A | 11/1996 | Reed | |
| 5,615,736 | A | 4/1997 | Reed | |
| 5,617,917 | A | 4/1997 | Squires | |
| 5,732,777 | A | 3/1998 | Grimshaw et al. | |
| 5,743,332 | A | 4/1998 | Lam et al. | |
| 5,765,813 | A | 6/1998 | Lam et al. | |
| 5,904,821 | A | 5/1999 | Blank et al. | |
| 6,026,898 | A | 2/2000 | Bland et al. | |
| 6,138,776 | A | 10/2000 | Hart et al. | |
| 6,176,466 | B1 | 1/2001 | Lam et al. | |
| 6,192,981 | B1 | 2/2001 | Boquet et al. | |
| 6,223,819 | B1 | 5/2001 | Heinonen | |
| 6,260,817 | B1 | 7/2001 | Lam et al. | |
| 6,296,225 | B1 | 10/2001 | Watts | |
| 6,457,530 | B1 | 10/2002 | Lam et al. | |
| 6,484,997 | B1 | 11/2002 | Edwards et al. | |
| 6,557,643 | B1 | 5/2003 | Hall et al. | |
| 6,595,278 | B1 | 7/2003 | Lam et al. | |
| 6,601,650 | B2 | 8/2003 | Sundararajan | |
| 6,719,262 | B2 | 4/2004 | Whitby et al. | |
| 6,843,313 | B2 | 1/2005 | Hult | |
| 6,857,634 | B2 | 2/2005 | Araujo | |
| 7,000,888 | B2 | 2/2006 | Wright et al. | |
| 7,017,881 | B2 | 3/2006 | Ward | |
| 7,137,610 | B2 | 11/2006 | Lam | |
| 2004/0021269 | A1 | 2/2004 | Gaudette et al. | |
| 2005/0045323 | A1 | 3/2005 | Hult | |
| 2007/0175626 | A1 | 8/2007 | Lam | |

FOREIGN PATENT DOCUMENTS

| | | |
|---|---|---|
| CA | 1136544 | 11/1982 |
| CA | 1142427 | 3/1983 |
| CA | 1142428 | 3/1983 |
| CA | 1157768 | 11/1983 |
| CA | 2171257 | 10/1996 |
| CA | 2153612 | 1/1997 |
| CA | 2197584 | 4/1997 |
| CA | 2169503 | 8/1997 |
| CA | 2177629 | 11/1997 |
| CA | 2266367 | 3/1998 |
| CA | 2190215 | 5/1998 |
| CA | 2218202 | 5/1998 |
| CA | 2216456 | 3/1999 |
| CA | 2260655 | 8/2000 |
| CA | 2280581 | 2/2001 |
| CA | 2287593 | 4/2001 |
| CA | 2291358 | 6/2001 |
| CA | 2331579 | 9/2001 |
| CA | 2349988 | 10/2001 |
| CA | 2311036 | 12/2001 |
| CA | 2350047 | 12/2001 |
| CA | 2331915 | 5/2002 |
| CA | 2368877 | 7/2003 |
| CA | 2397360 | 2/2004 |
| CA | 2436924 | 2/2004 |
| CA | 2411129 | 5/2004 |
| CA | 2462183 | 9/2005 |
| EP | 1443237 | 8/2004 |

OTHER PUBLICATIONS

Cameron, Excerpts from 1996-1997 Catalog.
Cameron, webpage—exceprts.
Double E Inc. "Production Blowout Preventer Ram s" product catalogue.
Double-E Inc. Slip Rams/Grip Rams.
Double-E, Inc. brochure, 1997.
Double-E, Inc. Drawing No. C12LP2 with attachment.
Double-E, Inc. Two drawings dated 1994.
Double-E, Inc. website—excerpts.
Dover Corp. Product Catalogue.
Excerpts from 1957 Composite Catalog.
Excerpts from 1982-1983 Composite Catalog.
Excerpts from 1988-1989 Composite Catalog.
Excerpts from 1990-1991 Composite Catalog.
Excerpts from 1992-1993 Composite Catalog.
Excerpts from 1994-1995 Composite Catalog.
Excerpts from 1996-1997 Composite Catalog.
Excerpts from 1998-1999 Composite Catalog.
Excerpts from Reissue Proceedings of CA Patent No. 2,349,998.
FMC Technologies—"Seals" Website.
Guiberson Product Catalogue.
J.P. Ratigan Inc. Product Catalogue.
Le Grant Sutcliff & Gell Ltd. Product Catalogue.
Monarch Engineering Corp. Product Catalogue.
Oil Lift Brochure—Oct. 2002.
Texas Oil Tools, 3.06 10M COMBI, Jun. 1996.
Texas Oil Tools, The Cutting Edge in Technology & Service, Apr. 1999.
Weltec-Alan "1500# Well Completion Blow-Out Preventer" product catalogue.

* cited by examiner

POLISH ROD CLAMPING DEVICE

CROSS-REFERENCE TO RELATED APPLICATIONS

This application claims priority from U.S. Provisional Patent Application No. 60/763,618 filed Jan. 31, 2006, which is incorporated by reference herein to the extent that there is no inconsistency with the present disclosure.

BACKGROUND OF THE INVENTION

The invention relates to a device capable of clamping, and preferably also sealing, the polish rod of a pumping wellhead.

A conventional wellhead comprises an assembly of spools, valves and assorted adapters which provide pressure control of a production well. In a rotary pumping oil well typical components include, from the bottom up:

a flanged casing head attached to the well casing;

a flanged tubing head having an internal hanger from which the well tubing string is suspended;

a tubing head adapter having a flanged connection at its bottom end and a threaded connection of smaller diameter at its top end;

a production blowout preventer (BOP) body having top and bottom threaded connections and including side openings for receiving the BOP ram components;

a flow tee body having threaded bottom and top connections and a threaded or flanged side opening for connecting with a flow line;

a polish rod stuffing box; and a rotary drive assembly for rotating the well's rod string to power a downhole progressive cavity pump.

These components, except for the rotary drive assembly, combine to form a vertical central bore extending through the pressure-containing wellhead body members. The polish rod of the rod string extends through this central bore in the pressure zone maintained in the wellhead body members. The polish rod rotationally drives a drive string or "sucker rods" which in turn drive the progressing cavity pump located at the bottom of the installation to produce well fluids to the surface through the wellhead.

The combination of the tubing head adapter, BOP body and flow tee body components is commonly collectively referred to as a "pumping tree." The assembly of wellhead components above the tubing head is usually referred to collectively as the "Christmas tree."

Composite wellhead assemblies exist which include, between a top connector and bottom connector, one or more of the following components, in any sequence, adapter, valve, gate valve, flow tee, blowout preventer, and polish rod clamp. To that end, attention is directed to the devices disclosed in the following U.S. Patents, all of which are owned by Stream-Flo Industries Ltd., the assignee of the present application:

U.S. Pat. No. 5,743,332, issued Apr. 28, 1998, entitled "Integral Wellhead Assembly for Pumping Wells. This patent teaches integrating the tubing head adapter, BOP body and flow tee body into a unitary structure, referred to as an 'integral or composite pumping tree', by forging, casting or machining a single steel body. This composite pumping tree forms the lower end of the Christmas tree.

U.S. Pat. No. 6,457,530, issued Oct. 1, 2002, entitled "Wellhead Production Pumping Tree". This patent is similar to U.S. Pat. No. 5,743,332, but includes a Y-arm to provide access for coiled tubing.

U.S. Pat. No. 6,176,466, issued Jan. 23, 2001, entitled "Composite Pumping Tree with Integral Shut-Off Valve. This patent application teaches integrating a tubing head adapter, shut-off valve body, BOP body, and flow tee body into a composite pumping tree.

U.S. Pat. No. 6,595,278, issued Jul. 22, 2003, entitled "Assembly for Locking a Polished Rod in a Pumping Wellhead". This patent includes multiple embodiments to incorporate a polish rod locking device in a composite pumping tree.

Each of the above patents discloses wellhead equipment used in connection with pumping oil wells, but in a composite form, meaning that one or more functional components of a conventional pumping tree are included in an integral pressure-containing wellhead body between a top and a bottom connector.

Canadian Patent No. 2,349,988 to Oil Lift Technology Inc. issued on May 7, 2002, discloses a polish rod lock out clamp for securing the polish rod in an oil well installation. In one embodiment, the polish rod lock out clamp is integrated with a blowout preventer. The pistons, or BOP rams, are of metal and include an arcuate recess (or radial groove) at their front or inner ends to accommodate and grip the polish rod in metal to metal contact. An elastomeric seal across the arcuate recess is provided to seal against the polish rod. To grip the polish rod, the arcuate recess has a diameter which is undersize relative to that of the polish rod. However, the smaller diameter of the arcuate recess in the ram can cause difficulty in aligning and gripping of an off-centre polish rod. As well, with repeated use in gripping the polish rod, the polish rod becomes scored or damaged as the clamp bites into the polish rod to achieve a sufficient gripping action. Damaging the polish rod in this manner can effectively reduce the diameter of the polish rod in this area, making it more difficult to clamp. Eventually, the damage to the polish rod can lead to an inability to seal against the downhole pressure in this area.

U.S. Pat. No. 7,000,888, issued Feb. 21, 2006, naming Andrew Wright et. al., as inventors, discloses a polish rod clamp or combination BOP/clamp for gripping a polish rod, without requiring the metal to metal contact set forth in the above Oil Lift patent. The clamping members in the Wright et al. patent application include gripping inserts, which may be coated with non-metallic ceramic materials, to clamp the polish rod without scoring or damaging the rod surface. This patent application still includes the arcuate recess (generally semi-circular in cross section) at the front ends of the clamping members, which can cause difficulties as set forth above in aligning with an off-centre polish rod.

SUMMARY OF THE INVENTION

With this background in mind, it is an objective of the present invention to provide a polish rod clamping device for use in a pressure-containing wellhead pumping tree operative to clamp onto the polish rod to prevent back-spin and to grip the polish rod with sufficient force so as to suspend the weight of the rod string. Preferably, the polish rod clamping device of this invention will also act as a blowout preventer to seal both against the polish rod and across the central bore. Preferably the sealing function is located separately from the clamping function in order to overcome the above-noted deficiencies of other prior art polish rod clamp/BOP devices. Preferably the polish rod clamping device is included as an integral component of a composite pumping tree.

In one broad aspect, the invention provides a polish rod clamping device, for use as part of a wellhead production pumping tree to secure a polish rod forming the upper end of a rod string extending through a vertical bore formed by the tree, comprising:

a pressure-containing body forming a central bore, which extends vertically through the body and through which the polish rod may extend, and opposed first and second side bores extending radially outwardly in opposite directions through the body and intersecting the central bore;

a pair of clamping rams positioned in the side bores for sliding movement therealong, each clamping ram having a front and a rear end, the front ends of the clamping rams being configured to accommodate at least a portion of the circumference of the polish rod between their front ends when the clamping rams are advanced across the central bore;

the front end of at least one of the clamping rams being configured with a vertical V-groove for gripping the polish rod; and actuator means connected to the rear end of each clamping ram for advancing and withdrawing the ram in the side bore, between a polish rod gripping position when the rams are advanced across the central bore into contact with the polish rod, and a polish rod releasing position when the rams are withdrawn from the polish rod.

The clamping device of the present invention, while illustrated herein in association with a polish rod, has broad application to the clamping of other tubular members such as a tubing string in a pressure-containing wellhead body member.

The polish rod clamping device of this invention, alone or as an integral composite assembly with other components, includes top and bottom connectors for connecting to the wellhead components located above and below. Such connectors may be of any type, as is known in the industry, including for example studded connectors, flange connections, welded connections, clamp connections and threaded connections.

The rams and side bores may be of any shape or configuration as is known for in the BOP art. While the figures show the rams and ram bores as being cylindrical, they may be alternatively shaped, such as oval or rectangular in cross section. As used herein, the term "cylindrical" is understood to include rams and ram bores which are generally circular or oval in cross section.

It should be understood that the terms "front", "rear", "top", "bottom", "side" and "lateral" as used herein and in the claims with reference to the wellhead components, the clamping ram or its parts, refer to the ram as it is designed to be positioned in one of the horizontal side bores, for movement forwardly into the central bore or rearwardly into the side bores out of the central bore. By "front", as used herein, is meant the portion or end of the ram or its parts at the central bore. By "rear" is meant the portion or end of the ram or its parts opposite the front. By "outer" is meant the outer circumferential portion of the ram or its parts. The term "central" in reference to the "central bore" is not meant to exclude a generally vertical bore which may be somewhat off-centre in the wellhead assembly in which it is included.

By "V-groove", as described herein and in the claims is meant a generally V-shaped groove (in cross section) formed in or at the front of a ram, extending at least a portion of the vertical length along the front of the ram, and sized to accommodate a tubular member, such that the circumference of the tubular member is at least partially within the V-groove at the contact points in the V-groove. The term "V-groove" is not meant to include only a strict V-shaped, rather it is meant to include all vertical grooves having leg portions which are inclined relative to each other at the contact points where the legs contact the tubular shaped member, and which converge toward an apex portion (which may be triangular, rounded or flat). Thus, the front leading edge of the "V-groove" may be shaped other than in a strict V-opening. For example, at the opening, the legs may have a different enclosed angle compared to the enclosed angle at the contact points to the tubular member, or the legs may be parallel to each other at the opening. As well, "V-groove" is meant to include a V-shaped groove that is V-shaped for only a portion of the vertical length of the front groove of the ram. Other portions of the front groove may be shaped differently, such as an arcuate, radial groove portion, provided the front groove overall still accommodates a portion of the tubular member. The size and geometry of the V-groove will vary with the diameter of the tubular member, the weight of to be suspended, and other well parameters such as wellhead pressure and conditions.

For sealing against the polish rod, the central bore and/or the side bores, the rams may carry elastomeric or thermoplastic seals, in any manner known in the art. "Elastomeric" materials include rubber type seal materials such as nitrile rubber seals. "Thermoplastic" materials include polytetrafluoroethylene (PTFE), ex. Teflon®, but preferably modified with fillers such as carbongraphite or glass, which strengthen the polymers. For environments which expose seals to chemicals, the strengthened thermoplastic polymers are preferred. Thermoplastic seals to the polish rod may be designed, for example, in accordance with U.S. Pat. No. 7,137,610 issued Nov. 22, 2006, naming Tony M. Lam as inventor, and assigned to Stream-Flo Industries Ltd. In U.S. Pat. No. 7,137,610, the thermoplastic seal is formed as an L-shaped seal component or wedge-shaped seal component which slides on a seat formed at the front of the steel ram body.

As well, the clamping ram of this invention finds application as an extended BOP ram designed to seal against either the polish rod, or against the central bore when the polish rod is not in place. This type of extended ram is described in detail in U.S. patent application Ser. No. 11/627,674, filed Jan. 26, 2007, naming Tony M. Lam as inventor, and owned by Stream-Flo Industries Ltd. In any of these BOP rams, the front vertical radial groove as formed in the steel body of the ram can be replaced, at least over a portion of groove, by the V-groove of this invention.

The invention extends to wellhead assemblies including the polish rod clamping device of this invention alone, or together in an integral composite assembly with one or more other components which might include, in any sequence, adaptors, control valves, additional BOP rams, check valves, and flow tee. The wellhead assembly of this invention includes top and bottom connectors for connecting to wellhead components located above and below. Such connectors may be of any type, as is known in the industry, including for example studded connectors, flange connections, welded connections, clamp and threaded connections. Importantly, the clamping device, when designed to also seal the central bore, may allow one or more of the extra BOP or shut-off valves in the wellhead or the composite wellhead assembly, to be omitted.

As used herein and in the claims, a reference to "a connection," "connected" or "connect(s)" is a reference to a sealed pressure-containing connection unless the context otherwise requires.

As used herein and in the claims, "comprising" is synonymous with "including," "containing," or "characterized by," and is inclusive or open-ended and does not exclude additional, unrecited elements.

The use of the indefinite article "a" in the claims before an element means that one or more of the elements is specified, but does not specifically exclude others of the elements being present, unless the contrary clearly requires that there be one and only one of the elements.

DETAILED DESCRIPTION OF THE INVENTION

Figure 1:
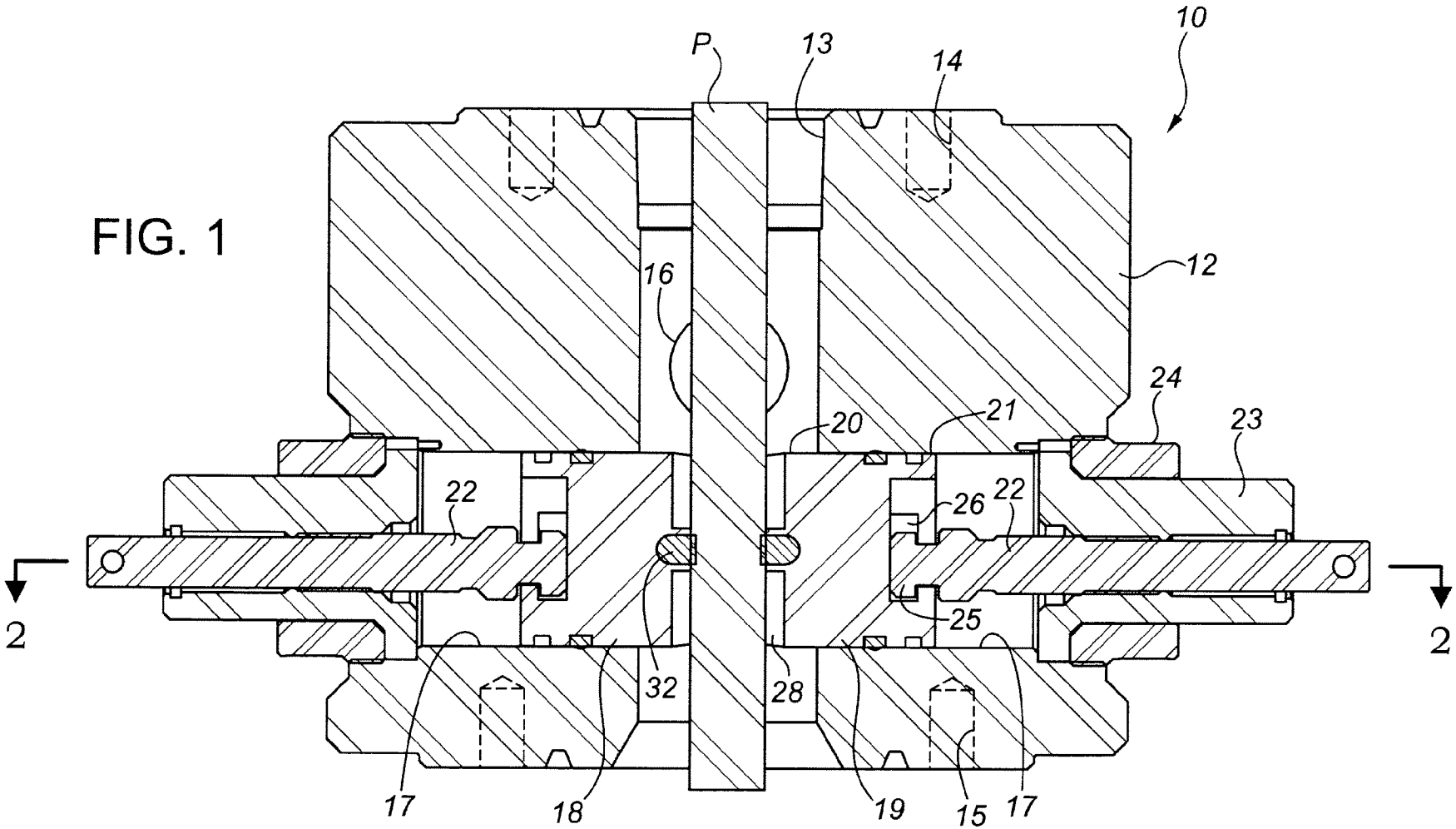
FIG. 1 is a side section view of one embodiment of the polish rod clamping device of this invention, shown functioning as a combined blowout preventer/polish rod clamp in a composite pumping tree of the type disclosed in U.S. Pat. No. 5,743,332.
Figure 2:
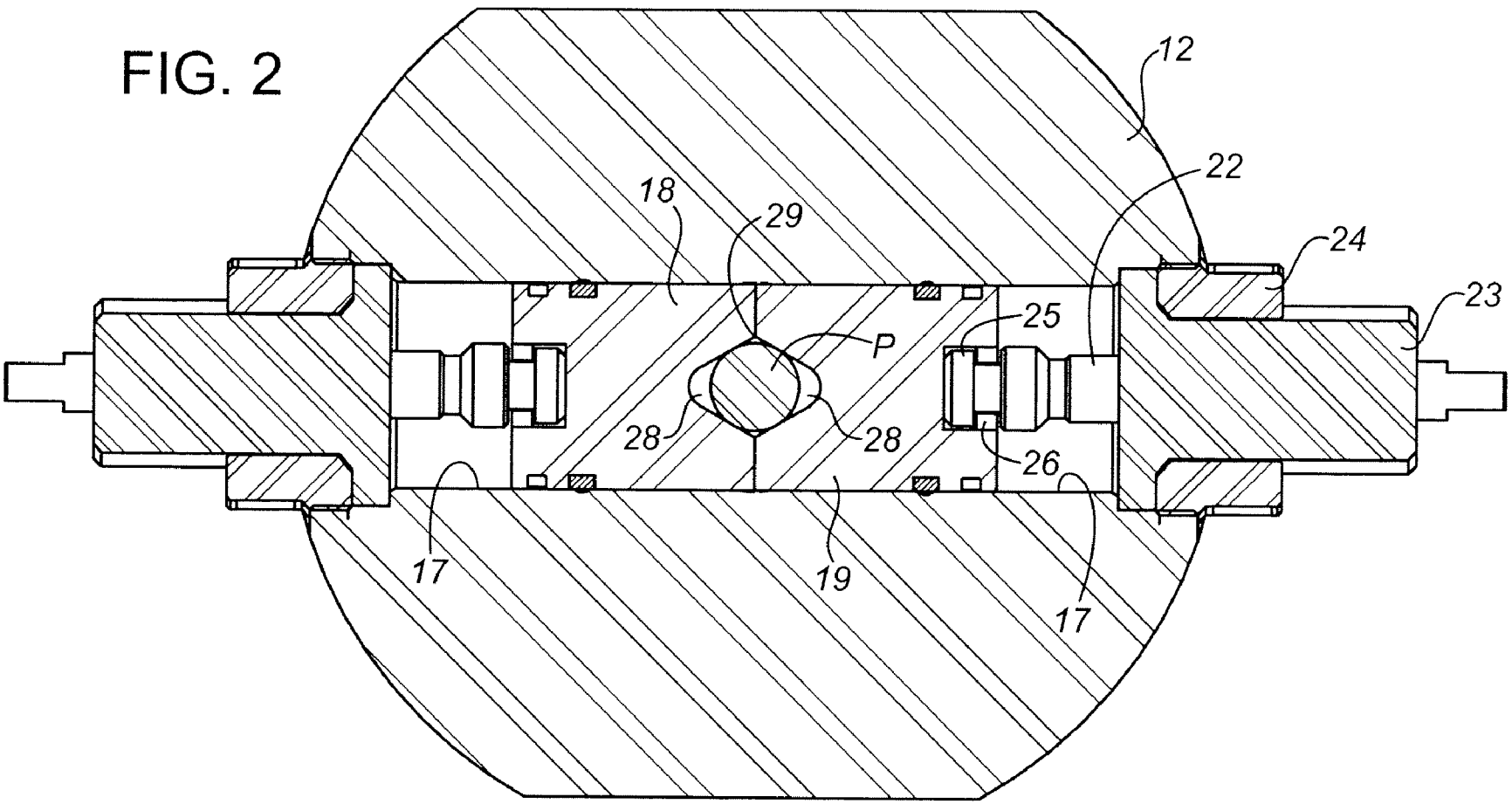
FIG. 2 is a section taken along line 2-2 of FIG. 1, showing the V-shaped profile of the vertical groove at the front of the clamping (BOP) rams.
Figure 3:
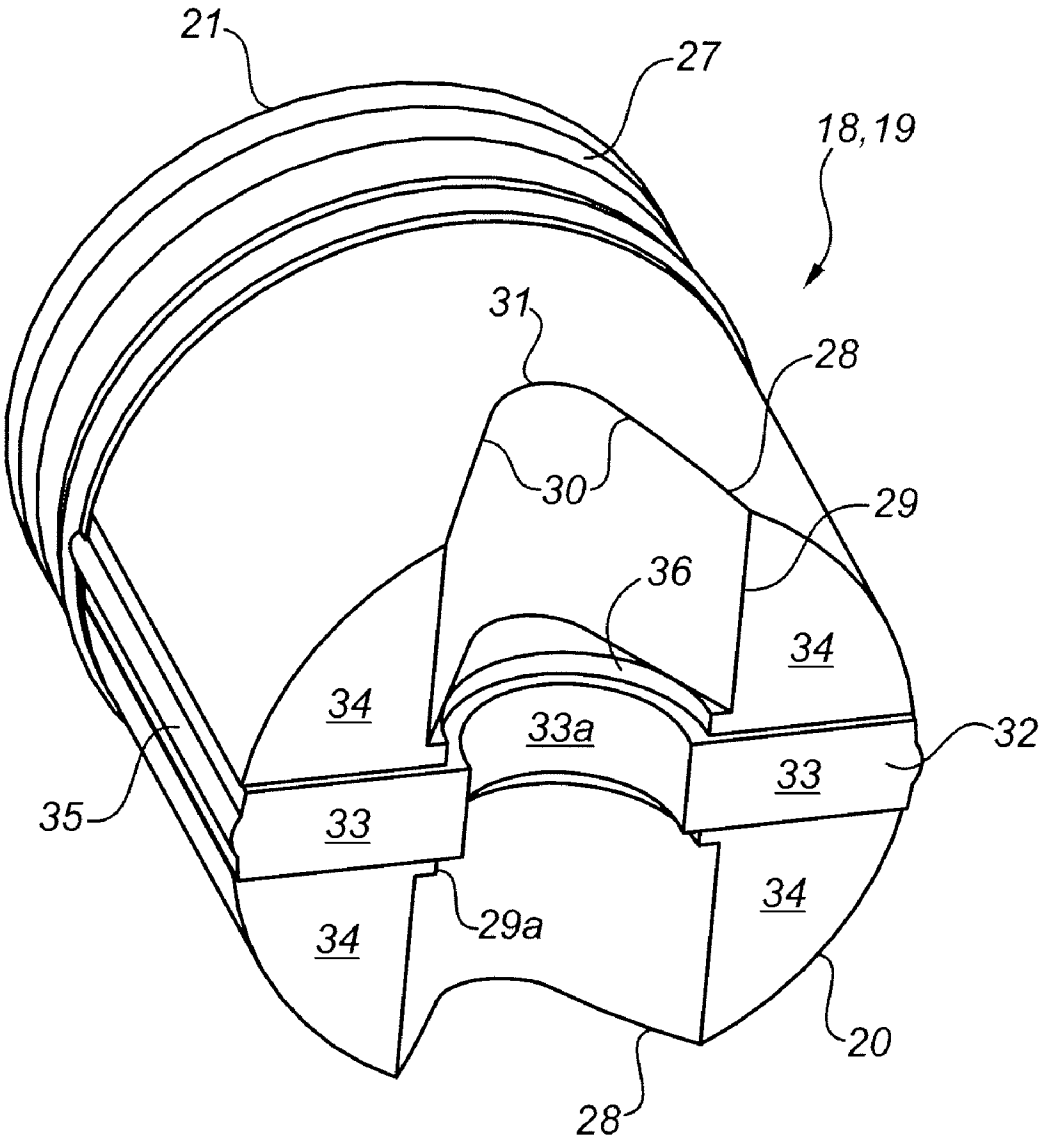
FIG. 3 is a front perspective view of one of the clamping rams of FIG. 1, showing the V-shaped groove and a polish rod seal located across the central portion of the clamping ram face, the sealing area being separate from the clamping or gripping area of the V-groove located above and below the seal.
Figure 4:
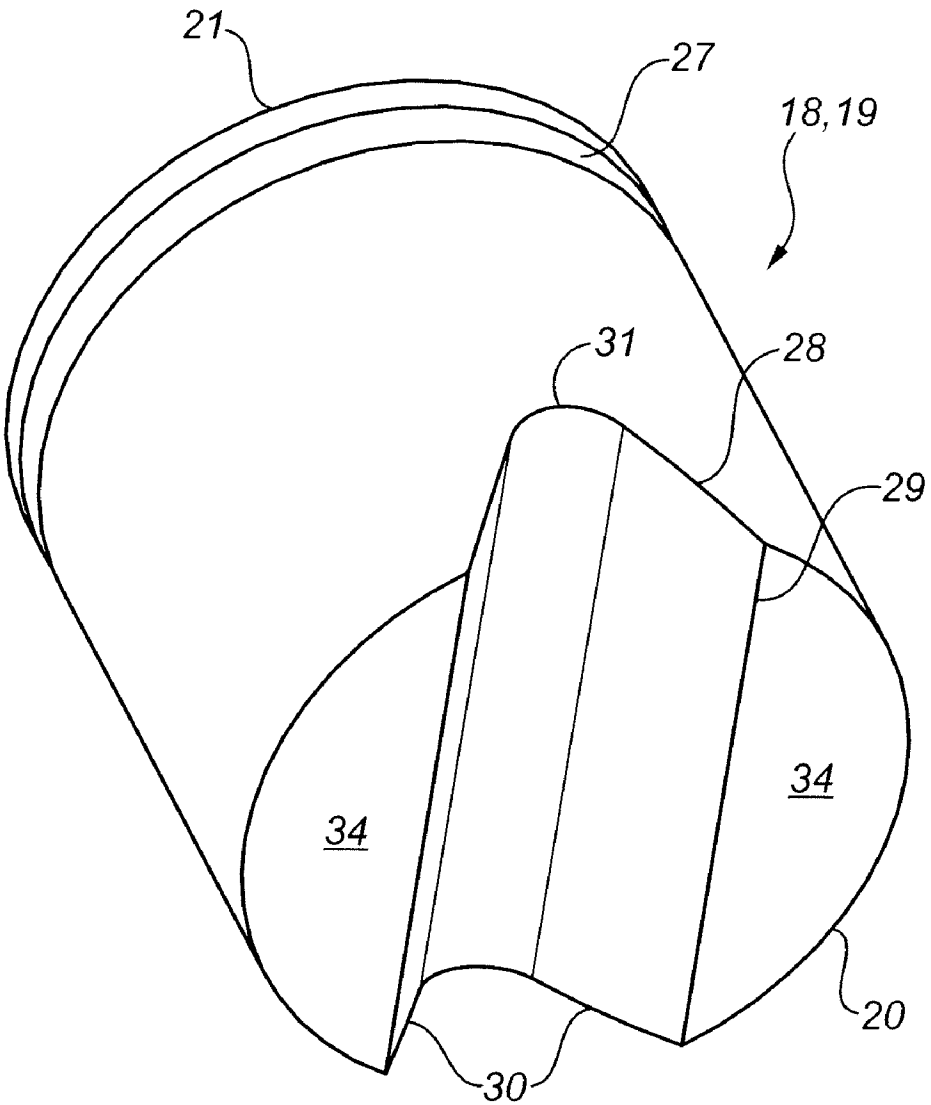
FIG. 4 is a front perspective view of an alternate clamping ram for a clamping device of this invention, in which the seal of FIG. 3 is omitted, such that the device functions only as a polish rod clamp.
Figure 5:
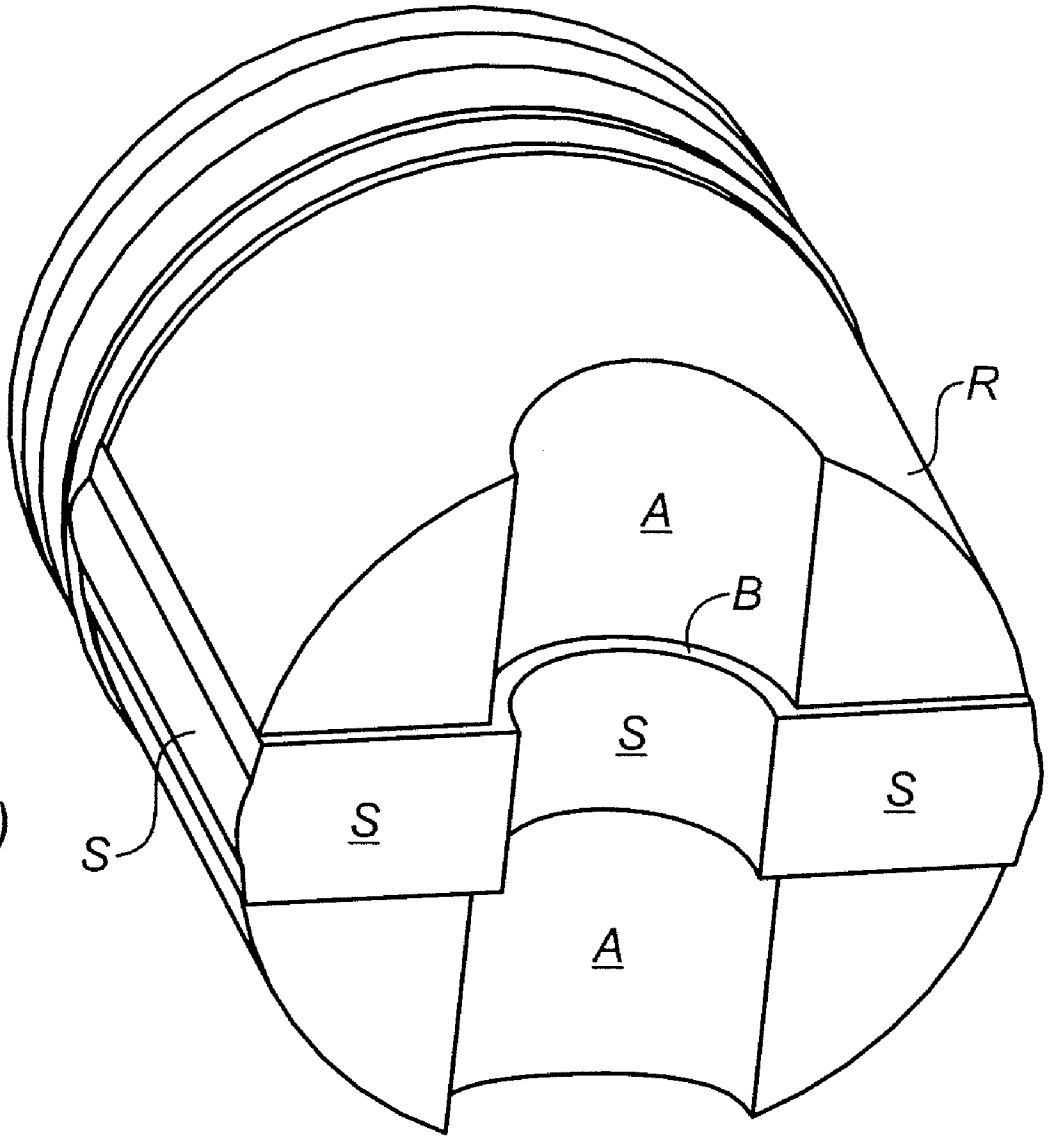
FIG. 5 (PRIOR ART)
FIG. 5 is a front perspective view of a conventional prior art BOP ram, showing the normal profile for the radial groove at the front of the BOP ram, which is generally semi-circular in cross-section.
Figure 6:
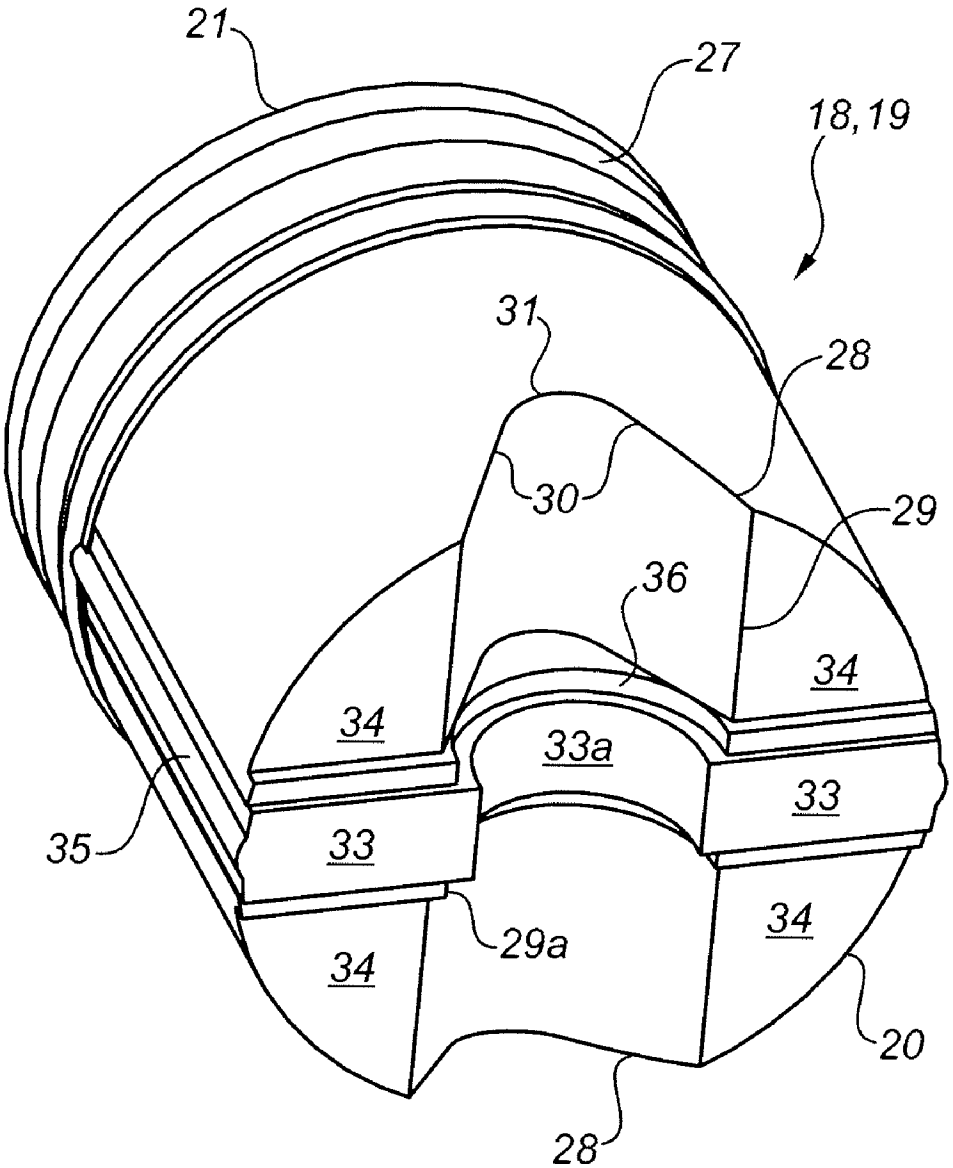
FIG. 6 is a front perspective view of an alternate clamping ram for a clamping device of this invention. The ram differs from that of FIG. 3 in that the leading edge of the V-groove is rearwardly recessed relative to the leading edge of the polish rod anti-extrusion sealing area. In this embodiment the size of the opening of the V-groove can be equal to or smaller than the diameter of the polish rod.
Figure 7:
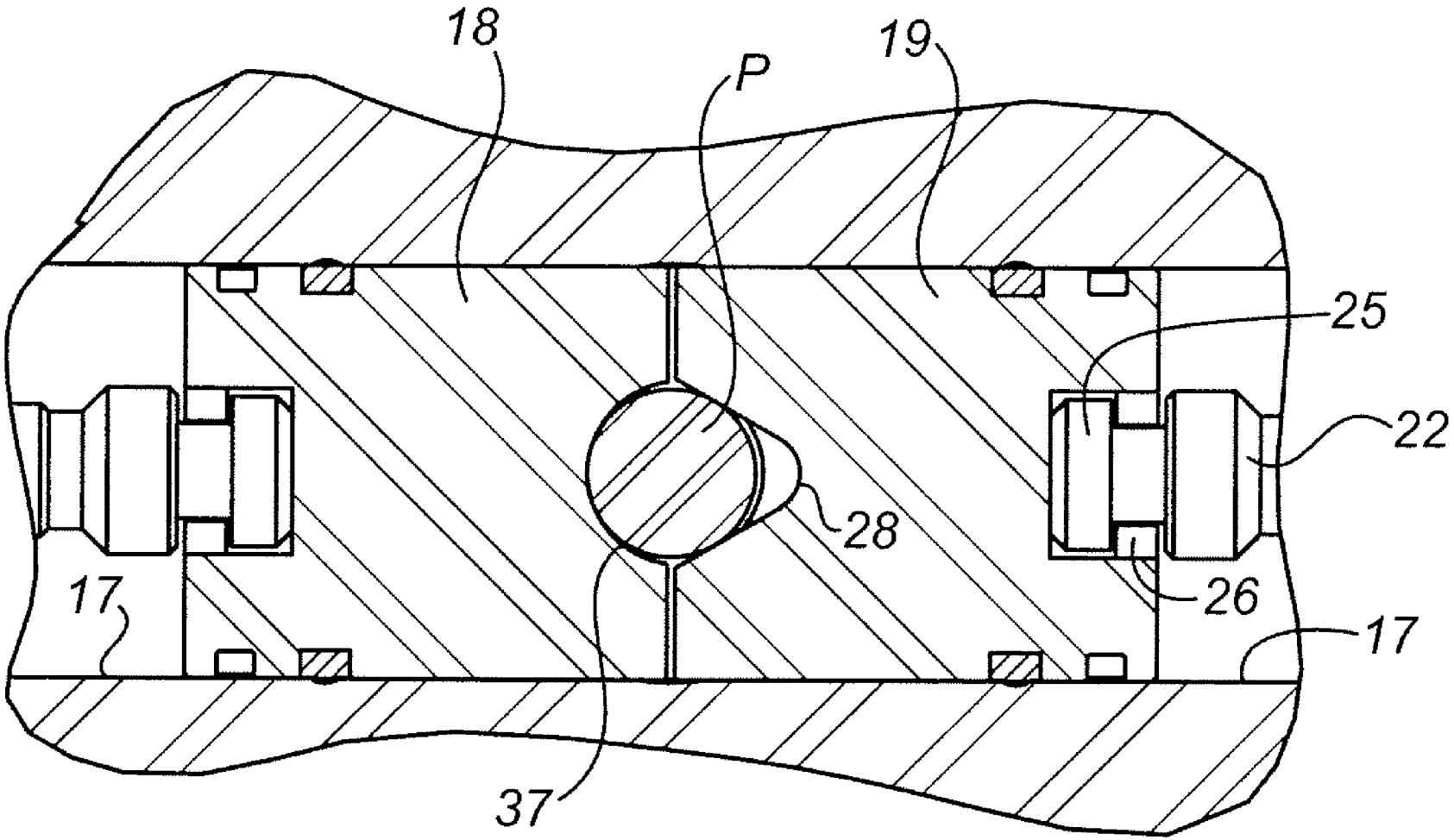
FIG. 7 is a partial sectional view of another embodiment of the clamping device, similar to the section of FIG. 2, but showing one of the clamping rams with a V-groove, while the opposing ram has a radial groove, to accommodate and clamp the polish rod.
Figure 8:
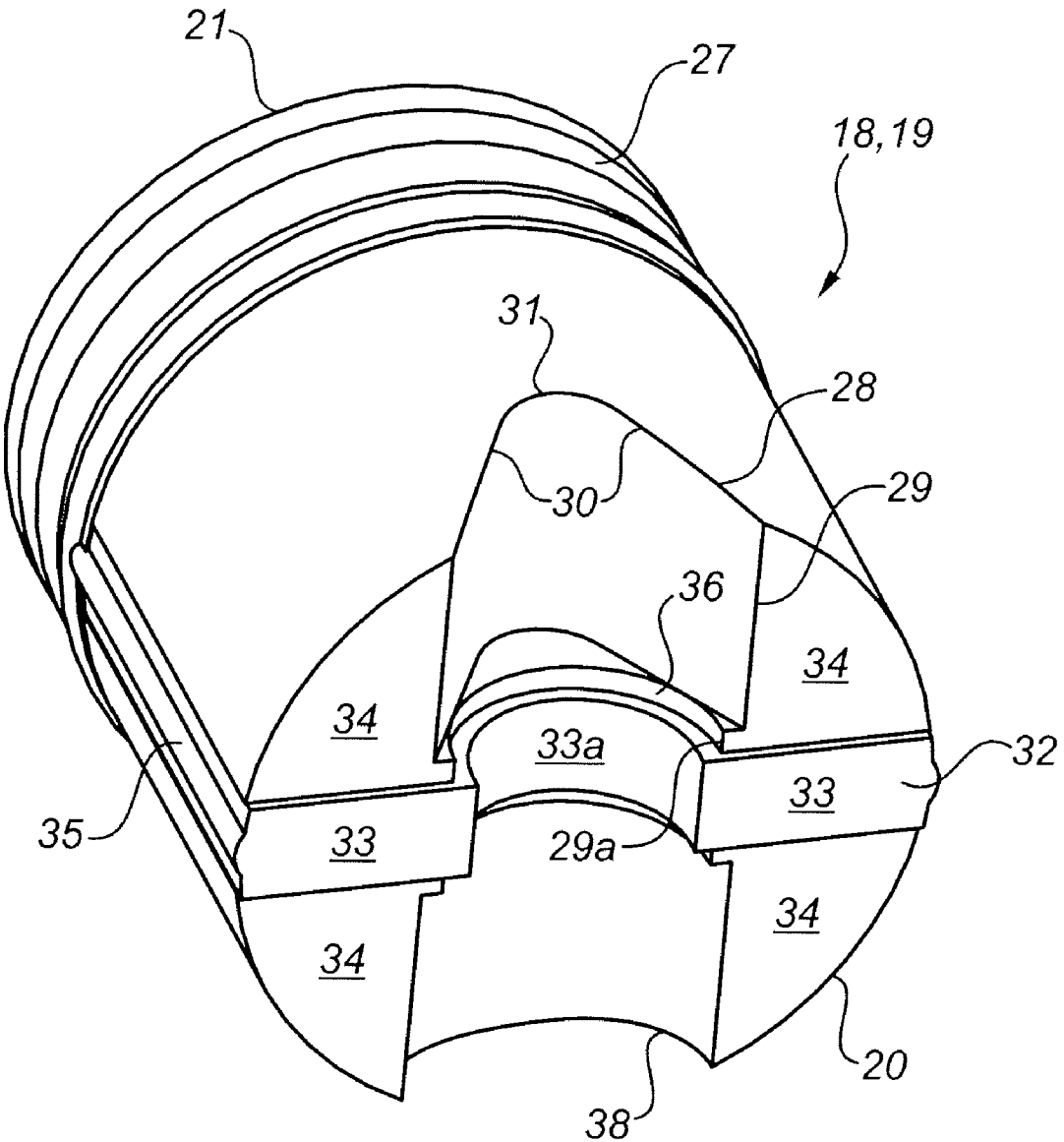
FIG. 8 is a front perspective view of an alternate clamping ram of this invention, which differs from that in FIG. 3 in that the V-groove is present at the top of the ram, above the polish rod seal, while a radial groove is present at the bottom of the ram, below the polish rod seal.

Multiple preferred embodiments of the production polish rod clamping device of the present invention are shown in the Figures. In FIGS. 1, 2 and 3, the invention is shown as a production blowout preventer (BOP) in a composite pumping tree. In FIG. 4, an embodiment of a polish rod clamping ram of this invention is shown without the central seals of FIGS. 1-3. FIG. 5 is included only to contrast the clamping rams of FIGS. 3 and 4 with a prior art BOP ram as shown in FIG. 5. In FIG. 5, the ram R has an arcuate or radial vertical groove A, and a central polish rod seal S which extends across the front face of the ram and longitudinally along its sides. In the front face, the seal S is formed on a machined metal anti-extrusion ridge B. FIGS. 6-8 show further alternate embodiments of the clamping rams of this invention.

It will be understood that the polish rod clamping device of this invention, with or without a sealing member, can be provided on its own, in a pressure-containing wellhead body member, or it may be combined integrally with one or more other composite wellhead members. In the Figures, like members are labeled with the same reference numerals.

The polish rod clamping device of this invention is shown in a first embodiment in FIGS. 1-3, as part of a composite pumping tree, and functioning as a combined blowout preventer/polish rod clamp.

Turning to FIGS. 1-3, the composite pumping tree, shown generally at 10 includes a pressure-containing steel body 12 forming a central bore 13 extending vertically therethrough. The central bore 13 forms part of the vertical internal bore of the pressure-containing wellhead, through which the polish rod P extends and through which fluid is produced. Top and bottom connections 14, 15 are formed to connect and seal to the wellhead components (not shown) located above and below. Typically, the top connection will be to a stuffing box (not shown), and the bottom connection will be to a tubing head (not shown). These connections 14, 15 may take any form, for example flanged, threaded, clamp-hub, rotatable flange, welded or studded connections, as is known in the art. The composite pumping tree 10 includes multiple side openings communicating with the central bore 13 to house the desired wellhead components. In FIG. 1, the pumping tree is shown to include side openings 16 for connection to a conventional flow line (not shown) through which well fluid is produced.

Below the side openings 16 is located the polish rod clamping device of this invention. The body 12 forms a pair of opposed horizontal side bores 17 which intersect the central bore 13. The side bores 17 as shown have diameters slightly larger than that of the central bore 13, as is common in BOP devices, but this is not necessary if the device is to function only as a clamping device. The polish rod P is shown in place in the central bore 13. Clamping rams 18, 19 are located within the side bores 17. The rams 18, 19 are shown in the most of the figures to be symmetrical, so like parts are labeled with the same numerals. The rams 18, 19 are shown in the Figures to include generally cylindrical steel ram bodies (when assembled, if in multiple parts) which preferably form full bore rams. The rams 18, 19 have front and rear ends 20, 21.

The rams 18, 19 are shown to be mechanically actuated by a pair of threaded rams screws 22 connected at the rear ends 21 of the rams 18, 19. The ram screws 22 can be turned to advance or retract the rams 18, 19 into or out of the central bore 13 with mechanical screw jacks (not shown). However, any known actuators may be used, such as hydraulic, pneumatic or electrical. The actuators move the rams 18, 19 along the side bores 17 between a polish rod gripping position (see FIGS. 1, 2) in which the front ends 20 of the rams 18, 19 contact the polish rod P, and a polish rod releasing position, in which the rams 18, 19 are open, and not in contact with the polish rod P.

Actuators may be single or double acting, as known in the art. Any of these mechanical screw jacks or alternate actuators thus illustrate actuator means for advancing and withdrawing the first and second rams 18, 19 between their open, sealing and central bore closing positions within the patent claims.

It should be understood that the side bores 17 and corresponding rams 18, 19 are not necessarily strictly cylindrical in shape. The rams 18,19 and bores 17 may take alternate shapes, such as oval in cross section, or even rectangular in cross section, as is known in the art, and as included within the patent claims.

The ram screws 22 each are externally threaded and extend through an internally threaded locking gland 23 held in place in the side bore 17 by a retainer gland 24, which is threaded into the body 12. The outer end of the ram screws 22 protrudes out of the locking gland 23 to be accessible for rotation. The ram screws 22 each have a T-shaped head 25 at their inner ends. The T-shaped head 25 is received in a correspondingly T-shaped slot 26 formed in the rear end 21 of each ram 18, 19. As a result of this connection and the offset center lines (see FIG. 1), the ram screws 22 and rams 18, 19 are connected for axial movement together, but the screws 22 can be turned without rotating the rams 18,19.

The rams 18, 19 preferably each carry a circumferential ring seal 27 held in circumferential grooves (not shown) at the rear ends 21 in order to seal in the side bores 17. The ring seal 27 is optional, as the gland assembly 23, 24 at the ends of the side bores 17 may alternatively be adapted to seal the side bores 17.

The front ends 20 of the rams 18, 19 are formed with a vertical V-groove 28 which extends vertically along at least a portion of its front end. The V-groove 28 is sized and generally V-shaped to accommodate the polish rod P along at least a portion of its vertical length. To accommodate a portion of the polish rod P, so that it is gripped within the V-groove 28, the diameter of the opening of the V-groove 28 may be sized larger than the diameter of the polish rod P. This is shown in FIG. 2, wherein the groove 28 is generally V-shaped in cross section, with its opening at the leading edge 29 preferably being larger than the diameter of the polish rod P. As noted in FIG. 6, described below, the leading edge 29 may alternatively be rearwardly recessed to accommodate the polish rod P, in which case the opening size of the V-groove 28 might be equal to or smaller than the diameter of the polish rod P. The V-groove 28 is formed by leg portions 30 which converge toward its apex portion 31 (which may be triangular, rounded or flat) in a manner such that at least a portion of the circumference of the polish rod P may be held in secure gripping contact (i.e., wedged) within the V of the leg portions 30 (see FIG. 2).

In FIGS. 1-3, the front ends of the rams 18, 19 are shown to carry a polish rod seal 32 (generally an elastomeric seal) which is installed or molded into grooves (not shown but located behind the seal 32) formed in the ram body. The seal 32 includes a front seal face portion 33 which extends horizontally across the entire front face 34 of the ram and protrudes from the front of the ram to seal both against the polish rod P and against the opposing ram when in the polish rod gripping position. This seal 32 is preferably located generally centrally (top to bottom) on the front face of the ram 18, 19, but it could be located higher or lower on the front face of the rams if desired. In the V-groove 28, the seal face portion 33 is generally semi-circular (in cross section) adjacent the apex portion 31 of the V-groove 28, in order to seal to the polish rod P. Behind the seal face portion 33 in the semi-circular sealing area, the ram body is shown to preferably include a semi-circular backing section 36. In FIG. 3, this backing section 36 is machined from the steel body of the ram, but it may also be provided by a separate anti-extrusion ring part (ex. a non-metallic half ring from a material such as Teflon®), as is known in the art. This backing section 36 (or anti-extrusion ring) prevents the seal 32 from being extruded under pressure. This semi-circular sealing area (also termed anti-extrusion sealing area) is shown as 33*a* in FIG. 3. The leading edge 29*a* of this semi-circular sealing area 33*a* (i.e., the leading edge of the metal backing section 36 in this area) can have an opening diameter which is slightly larger than the diameter of the polish rod P, since this area need only seal to the polish rod P, and does not need to serve the clamping function which is achieved by the V-groove 28 itself. The diameter of the semi-circular sealing area 33*a* is preferably equal to, or preferably slightly greater than, the diameter of the polish rod P.

The seal 32 preferably also includes longitudinal side (or lateral) rib portions 35 which extend radially outwardly from the sides of the steel ram body to seal the central bore 13 when in the polish rod gripping position.

A front seal somewhat as disclosed herein, but without the V-groove, is also shown in U.S. Pat. No. 5,765,813, issued Jun. 16, 1998 to Lam et. al., and owned by Stream-Flo Industries Ltd. However, alternate front seal configurations may be used, as is known in the art. Alternatively, the front seals may be omitted, as shown in the ram in FIG. 4. In this configuration, the device of this invention functions only as a polish rod clamp.

The V-groove clamping rams of this invention can be configured as BOP rams in virtually any BOP design. The invention has particular application in a BOP ram carrying thermoplastic seals at its front face, such as are shown in U.S. Pat. No. 7,137,610. The steel body portion of such rams can be readily altered to include the V-groove at its front face. As well, the invention has application in an extended BOP ram of the type shown in co-pending U.S. patent application Ser. No. 11/627,674, filed Jan. 26, 2007, This extended BOP ram has an extended central bore sealing section formed behind its front face, operative to seal across the central bore when the polish rod is removed from the central bore. Hereagain, the front radial groove of this extended BOP ram can be readily replaced by the V-groove of this invention. All such BOP ram designs are meant to be included within the claims of this application.

It should also be understood that the rams of this invention, although shown as symmetrical, may be varied one from another, provided at least one of the rams 18, 19 is configured with at least a portion of its front end forming a vertical V-groove to accommodate the polish rod in a gripping mode.

Several alternate embodiments of the clamping rams of this invention are shown in FIGS. 6-8. In FIG. 6, the rams 18, 19 differs from that of FIG. 3 in that the leading edge 29 of the V-groove 28 is machined such that it is rearwardly recessed relative to the leading edge 29*a* of the semi-circular polish rod seal portion 33*a* of the groove. In this embodiment, the size of the opening at the leading edge 29 of the V-groove can be equal to or smaller than the diameter of the polish rod P.

In FIG. 7, one of the clamping rams 19 is formed with a V-groove 28, while the opposing ram 18 has a radial groove 37, to accommodate and clamp the polish rod P These rams may be configured with or without polish rod seals such as shown in previous embodiments, depending on whether the device is to function as a clamp only, or as a BOP/polish rod clamping device.

In FIG. 8, the clamping ram 18, 19 differ from that in FIG. 3 in that the V-groove 28 is present at the top of the rams 18, 19, above the polish rod seal 32, while a radial groove 38 is present at the bottom of the rams 18, 19, below the polish rod seal 32. The V-shaped, and radial-shaped portions of the front groove can be reversed if desired, but generally, they will have mirror symmetry with the other opposing ram in order to effectively seal and grip the polish rod P.

The metal steel surface of the V-groove 28 may be textured, coated, or modified to carry inserts which may be textured, coated or uncoated. Coatings may be non-metallic or metallic coatings (not shown) such as ceramics and frictional materials. Texturing can be added by machining grooves or roughened portions at the gripping surface of the V-groove. These textured surfaces, coatings or inserts can reduce damage to the polish rod P, while improving the frictional contact with the polish rod P. As well, the surface of the V-groove 28, or an insert in the V-groove (not shown), may be hardened, such as by nitride heat treatment, to improve the grip to the polish rod P.

The clamping rams of this invention provide several advantages over polish rod clamps of the prior art. The vertical V-groove 28 at the front of the rams 18, 19 accommodates and better guides into place, a polish rod P which is off-centre. The V-groove rams 18, 19 of this invention are easier to align with and centralize the polish rod P. The clamping function of the V-groove ram is preferably separated from the sealing function of any seals 32 carried at the front face of the rams 18, 19, which may improve the life of the rams 18, 19, seals 32 and polish rod P. Importantly, the V-groove rams 18, 19 have been demonstrated to require less torque or force to grip and suspend a polish rod P, than is required by polish rod clamps of the prior art which are designed with semi-circular grooves in their front faces. For a polish rod of diameter 1.25", the V-groove rams of FIGS. 1-3 were tested and shown to be capable of suspending a rod weight of 60000 lb using a torque on the operating screw of 400 ft*lb. A comparable BOP ram configured as in FIG. 5 (with a radial groove having a diameter slightly larger than that of the polish rod) was tested and found to be capable of suspending a rod weight of only 40000 lb with a torque of 800 ft*lb.

The invention also extends to a composite wellhead assembly including, between its top connector and bottom connector, a polish rod clamping device as described above, together with one or more of the following components, in any sequence, adapters, valves, gate valves, flow tee, and additional blowout preventers. To that end, attention is directed to the devices disclosed in the following U.S. Patents, all of which are commonly owned by Stream-Flo Industries Ltd.: U.S. Pat. No. 5,743,332, issued Apr. 28, 1998, entitled "Integral Wellhead Assembly for Pumping Wells"; U.S. Pat. No. 6,457,530, issued Oct. 1, 2002, entitled "Wellhead Production Pumping Tree"; U.S. Pat. No. 6,176,466, issued Jan. 23, 2001, entitled "Composite Pumping Tree with Integral Shut-Off Valve"; and U.S. Pat. No. 6,595,278, issued Jul. 22, 2003, entitled "Assembly for Locking a Polished Rod in a Pumping Wellhead". Each of these patents discloses wellhead equipment used in connection with pumping oil wells, but in a composite form, meaning that one or more functional components of a conventional pumping tree are included in an integral body housing between a top and a bottom connector. Such components may include a shut off valve, a blowout preventer, a flow tee and an adapter.

The invention also extends to the clamping rams themselves, formed with or without the front face seals.

All references mentioned in this specification are indicative of the level of skill in the art of this invention. All references are herein incorporated by reference in their entirety to the same extent as if each reference was specifically and individually indicated to be incorporated by reference. However, if any inconsistency arises between a cited reference and the present disclosure, the present disclosure takes precedence. Some references provided herein are incorporated by reference herein to provide details concerning the state of the art prior to the filing of this application, other references may be cited to provide additional or alternative device elements, additional or alternative materials, additional or alternative methods of analysis or application of the invention.

The terms and expressions used are, unless otherwise defined herein, used as terms of description and not limitation. There is no intention, in using such terms and expressions, of excluding equivalents of the features illustrated and described, it being recognized that the scope of the invention is defined and limited only by the claims which follow. Although the description herein contains many specifics, these should not be construed as limiting the scope of the invention, but as merely providing illustrations of some of the embodiments of the invention. One of ordinary skill in the art will appreciate that elements and materials other than those specifically exemplified can be employed in the practice of the invention without resort to undue experimentation. All art-known functional equivalents, of any such elements and materials are intended to be included in this invention. The invention illustratively described herein suitably may be practiced in the absence of any element or elements, limitation or limitations which is not specifically disclosed herein.

What is claimed is:

1. A clamping device for use as part of a wellhead to secure a tubular member, comprising:

a pressure-containing body forming a central bore, which extends vertically through the body and through which the tubular member may extend, and opposed side bores extending radially outwardly in opposite directions through the body and intersecting the central bore;

a pair of clamping rams positioned in the side bores for sliding movement therealong, each clamping ram having a front and a rear end, the front ends of the clamping rams being configured to accommodate at least a portion of the circumference of the tubular member between their front ends when the clamping rams are advanced across the central bore;

the front end of at least one of the clamping rams being configured with a vertical V-groove for gripping the tubular member such that a portion of the circumference of the tubular member is accommodated within the V-groove at contact points in the V-groove; and an actuator connected to the rear end of each clamping ram for advancing and withdrawing the ram in the side bore, between a gripping position when the rams are advanced across the central bore into contact with the tubular member with the portion of the circumference of the tubular member accommodated within the V-groove, and a releasing position when the rams are withdrawn from the tubular member.

2. A polish rod clamping device, for use as part of a wellhead production pumping tree to secure a polish rod forming the upper end of a rod string extending through a vertical bore formed by the pumping tree, comprising:

a pressure-containing body forming a central bore, which extends vertically through the body and through which the polish rod may extend, and opposed side bores extending radially outwardly in opposite directions through the body and intersecting the central bore;

a pair of clamping rams positioned in the side bores for sliding movement therealong, each clamping ram having a front and a rear end, the front ends of the clamping rams being configured to accommodate at least a portion of the circumference of the polish rod between their front ends when the clamping rams are advanced across the central bore;

the front end of one or both of the clamping rams being configured with a vertical V-groove for gripping the polish rod such that a portion of the circumference of the polish rod is accommodated within the V-groove at contact points in the V-groove; and an actuator connected to the rear end of each clamping ram for advancing and withdrawing the ram in the side bore, between a polish rod gripping position when the rams are advanced across the central bore into contact with the polish rod with the portion of the circumference of the polish rod accommodated within the V-groove, and a polish rod releasing position when the rams are withdrawn from the polish rod.

3. The clamping device of claim 2, wherein:

to accommodate the polish rod, both of the clamping rams are configured with a vertical groove extending the entire length of the front end of the clamping ram one or more portions of the vertical groove are configured with the V-groove;

one or more portions of the vertical groove are configured with an arcuate radial groove located above, below or between the one or more V-groove portions; and the clamping rams are configured to have mirror symmetry with each other.

4. The clamping device of claim 2, wherein both of the clamping rams are configured with the vertical V-groove and the V-grooves on each clamping ram aligns with each other when in the polish rod gripping position for gripping the polish rod.

5. The clamping device of claim 4, wherein the front end of each of the clamping rams carries one or more polish rod seals for sealing against the polish rod.

6. The clamping device of claim 2, wherein the front end of one or both of the clamping rams carries one or more polish rod seals for sealing against the polish rod, and wherein the one or more seals are located separately from a portion of the V-groove that grips the polish rod, such that a sealing area to the polish rod is separate from the gripping portion of the V-groove.

7. The clamping device of claim 5, wherein the clamping rams are steel bodied rams.

8. The clamping device of claim 7, wherein the one or more polish rod seals are provided by a seal which extends horizontally across the front face of the rams and across a semi-circular anti-extrusion sealing area formed adjacent the apex of the V-groove.

9. The clamping device of claim 8, wherein the semi-circular anti-extrusion sealing area is has a diameter which is equal to or greater than the diameter of the polish rod.

10. The clamping device of claim 9, wherein the semi-circular anti-extrusion sealing area is located generally centrally within the V-groove.

11. The clamping device of claim 10, wherein the seal also extends longitudinally along the sides of the ram body to seal across the central bore.

12. The clamping device of claim 7, wherein the one or more polish rod seals is provided by a thermoplastic seal insert carried at the front end of the steel bodied ram, and wherein the V-groove is formed in the steel bodied ram.

13. The clamping device of claim 2, wherein the V-groove extends vertically along the entire front end of the clamping ram.

14. The clamping device of claim 4, wherein the V-groove extends vertically along the entire front end of both of the clamping rams.

15. The clamping device of claim 7, wherein the one or more polish rod seals are located separately from a portion of the V-groove that grips the polish rod, such that a sealing area to the polish rod is separate from the gripping portion of the V-groove.

16. The clamping device of claim 8, wherein the V-groove extends vertically along the front end of each of the clamping rams above and below the seal.

17. The clamping device of claim 11, wherein the V-groove extends vertically along the entire front end of each of the clamping rams, above and below the seal.

18. The clamping device of claim 7, wherein the front ends of the clamping rams are configured such that the one or more polish rod seals contact each other in sealing relationship to seal the central bore, with the polish rod being gripped and sealed within the aligned V-grooves, when the clamping rams are in the polish rod gripping position.

19. The clamping device of claim 11, wherein the front ends of the clamping rams are configured such that the seals contact each other in sealing relationship to seal the central bore, with the polish rod being gripped within the aligned V-grooves and sealed within the semi-circular anti-extrusion sealing area, when the clamping rams are in the polish rod gripping position.

20. The clamping device of claim 19, wherein the semi-circular anti-extrusion sealing area forms an opening at its leading edge which is equal to or larger than the diameter of the polish rod.

21. The clamping device of claim 19, wherein the V-groove forms an opening at its leading edge which is larger than the diameter of the polish rod.

22. The clamping device of claim 19, wherein the V-groove and the semi-circular anti-extrusion sealing area form openings at their leading edges, and wherein the leading edge of the V-groove is rearwardly recessed relative to the leading edge of the semi-circular anti-extrusion sealing area.

23. The clamping device of claim 2, wherein the V-groove is hardened, textured, coated or modified to carry an insert which may be hardened, textured, or coated, in order to enhance frictional contact or grip to the polish rod.

24. The clamping device of claim 19, wherein the V-groove is hardened, textured, coated or modified to carry an insert which may be hardened, textured, or coated, in order to enhance frictional contact or grip to the polish rod.

25. The clamping device of claim 2, wherein the clamping rams and side bores are generally cylindrical, and wherein the rams carry one or more seals at their rear ends for sealing against the side bores.

26. The clamping device of claim 19, wherein the clamping rams and side bores are generally cylindrical, and wherein the rams carry one or more seals at their rear ends for sealing against the side bores.

27. The clamping device of claim 2, wherein the body provides a top connector and a bottom connector for connecting and sealing to wellhead components located above and below the body.

28. The clamping device of claim 26, wherein the body provides a top connector and a bottom connector for connecting and sealing to wellhead components located above and below the body.

29. A composite wellhead assembly including, between a top connector and a bottom connector, a clamping device together with one or more of the following wellhead components, in any sequence: adapter, valve, gate valve, flow tee, and blowout preventer, said clamping device comprising:

a pressure-containing body forming a central bore, which extends vertically through the body and through which the polish rod may extend, and opposed side bores extending radially outwardly in opposite directions through the body and intersecting the central bore;

a pair of clamping rams positioned in the side bores for sliding movement therealong, each clamping ram having a front and a rear end, the front ends of the clamping rams being configured to accommodate at least a portion of the circumference of the polish rod between their front ends when the clamping rams are advanced across the central bore;

the front end of one or both of the clamping rams being configured with a vertical V-groove for gripping the polish rod such that a portion of the circumference of the polish rod is accommodated within the V-groove at contact points in the V-groove; and an actuator connected to the rear end of each clamping ram for advancing and withdrawing the ram in the side bore, between a polish rod gripping position when the rams are advanced across the central bore into contact with the polish rod with the portion of the circumference of the polish rod accommodated within the V-groove, and a polish rod releasing position when the rams are withdrawn from the polish rod.

30. The clamping device of claim 28, further comprising the clamping device together with one or more of the following wellhead components, in any sequence: adapter, valve, gate valve, flow tee, and blowout preventer located between the top connector and the bottom connector.

31. A clamping ram, for use as part of a wellhead production pumping tree to secure a polish rod forming the upper end of a rod string extending through a vertical bore formed by the pumping tree, the pumping tree providing a pressure-containing body forming a central bore, which extends vertically through the body and through which the polish rod may extend, and opposed side bores extending radially outwardly in opposite directions through the body and intersecting the central bore, the clamping ram comprising;

a clamping ram adapted to be positioned in one of the side bores for sliding movement therealong, the clamping ram having a front and a rear end, the front end being configured to accommodate, with an opposing clamping ram, at least a portion of the circumference of the polish rod when the clamping ram and the opposing clamping ram are advanced across the central bore, and the front end being configured with a vertical V-groove for gripping the polish rod such that a portion of the circumference of the polish rod is accommodated within the V-groove at contact points in the V-groove.

32. The clamping ram of claim 31, wherein:

the clamping ram is a steel bodied ram;

the front end of the clamping ram is configured to contact and seal to an opposing mirror image clamping ram;

the front end of the clamping ram carries one or more polish rod seals extending horizontally across the front face of the ram and across a semi-circular anti-extrusion sealing area located generally centrally within the V-groove, the semi-circular anti-extrusion sealing area being formed adjacent the apex of the V-groove and having a diameter which is equal to or greater than the diameter of the polish rod:

the clamping ram further includes seals extending longitudinally along the sides of the ram body to seal across the central bore.

33. The clamping ram of claim 32, wherein the V-groove is hardened, textured, coated or modified to carry an insert which may be hardened, textured, or coated, in order to enhance frictional contact or grip to the polish rod.

34. The clamping ram of claim 33, wherein the clamping ram is generally cylindrical, and carries one or more seals at the rear end for sealing against the side bores.

* * * * *